United States Patent [19]

Dassler

[11] 4,202,116

[45] May 13, 1980

[54] SPORT SHOE TREAD

[76] Inventor: Armin A. Dassler, Ringstrasse 121, D-8522 Herzogenaurach, Fed. Rep. of Germany

[21] Appl. No.: 941,589

[22] Filed: Sep. 12, 1978

[30] Foreign Application Priority Data

Sep. 12, 1977 [DE] Fed. Rep. of Germany ... 7728190[U]

[51] Int. Cl.[2] ..... A43B 23/28; A43C 15/02

[52] U.S. Cl. ..... 36/59 R; 36/59 A; 36/59 C; 36/30 R

[58] Field of Search ..... 36/59 R, 59 A, 59 C, 36/30 R, 67 R, 67 A, 67 B, 129, 114

[56] References Cited

U.S. PATENT DOCUMENTS

| | | | |
|---|---|---|---|
| 1,176,647 | 3/1916 | Bucolo | 36/59 A |
| 1,697,019 | 1/1929 | Pickering | 36/59 R |
| 1,704,187 | 3/1929 | Glidden et al. | 36/30 R |
| 1,846,450 | 2/1932 | Packard | 36/59 C |
| 4,085,526 | 4/1978 | Hemmer | 36/59 R |

FOREIGN PATENT DOCUMENTS

| | | | |
|---|---|---|---|
| 836899 | 4/1952 | Fed. Rep. of Germany | 36/59 R |
| 19362 | of 1904 | United Kingdom | 36/59 A |

*Primary Examiner*—James Kee Chi

*Attorney, Agent, or Firm*—Craig & Antonelli

[57] ABSTRACT

A tread for a sport shoe which includes a sole having projections extending outwardly from a tread surface. The tread includes a one-piece, thin-walled, metal part with at least two separate, dimensionally reinforced surface sections bearing the integrally molded projections. The reinforced surface sections may include a plurality of embossed, smooth-surfaced and/or bevelled projections. The metal part is fixedly attached to an inner surface of the shoe sole by either a thin wire grid embedded in the synthetic resin sole or uniformly distributed perforations.

5 Claims, 2 Drawing Figures

SPORT SHOE TREAD

The present invention relates to a shoe and, more particularly, to a tread for a sport shoe, which tread is provided with projections extending out of a tread surface.

The aim underlying the present invention essentially resides in providing a sport shoe having a non-skid sport shoe tread which employs a maximum number of rigid and durable projections, while maintaining or complying with the standard regulations regarding admissible total thickness of a sport shoe sole.

According to one advantageous feature of the present invention, a sport shoe tread is provided which includes a one-piece, thin-walled metal part having at least two separate, dimensionally reinforced surface pieces or sections bearing integrally molded projections.

In accordance with another feature of the present invention, the reinforced surface pieces or sections are pressed or stamped with a plurality of embossed, smooth-surfaced and/or pressed-through bevelled projections in the metal part.

According to a further feature of the present invention, the dimensionally reinforced surface pieces or sections, located in a toe or ball area of the sport shoe, are surrounded by flat edge areas and are separated from each other by a flat bending zone which is narrowed from the lateral edges.

According to an additional feature of the present invention, the metal part is fixedly attached at its inner surface to a synthetic resin sole, which sole extends beyond the metal part at the lateral edges.

Yet another advantageous feature of the present invention resides in the fact that the metal part may be welded along its inner surface to a thin wire grid embedded in the synthetic resin sole, with the sole filling the projections.

In accordance with the present invention, the metal part may be provided with uniformly distributed perforations which serve to anchor the metal part to the synthetic resin sole.

Accordingly, it is an object of the present invention to provide a shoe tread for a sport shoe which avoids the shortcomings and disadvantages encountered in the prior art.

Yet another object of the present invention resides in providing a sport shoe tread which is simple in construction and relatively simple to manufacture.

A further object of the present invention resides in providing a sport shoe tread which assures a desired flexibility and minimizes the weight of the sport shoe.

Figure 1:
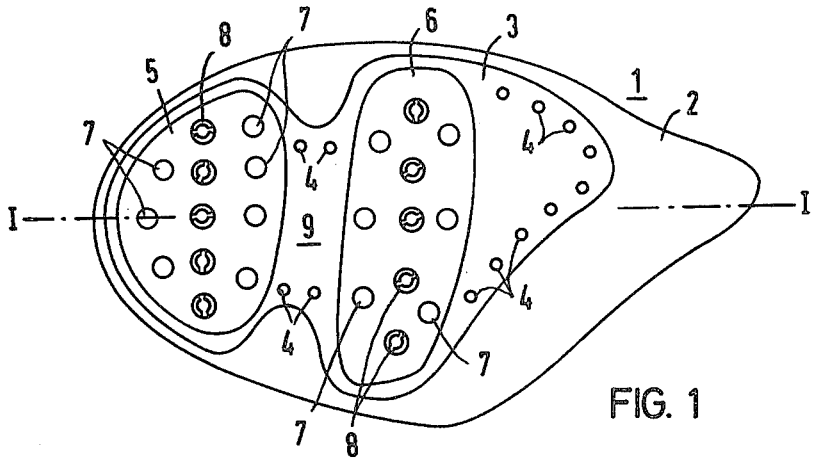
Figure 2:
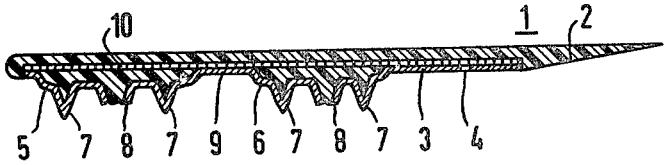

These and other objects, features and advantages of the present invention will become more apparent from the following description when taken in connection with the accompanying drawings which show, for the purposes of illustration only, one embodiment in accordance with the present invention, and wherein:

FIG. 1 is a bottom or tread view of a sport shoe tread in accordance with the present invention; and FIG. 2 is a longitudinal cross-sectional view taken along the line I—I in FIG. 1.

Referring now to the drawings wherein like reference numerals are used in both views to designate like parts and, more particularly, to FIG. 1, a sport shoe tread 1 includes a flexible synthetic resin sole 2 made of an injection molded or cast polyamide. The synthetic resin sole 2 is adapted to be connected to an upper portion of the sport shoe (not shown). A one-piece, thin-walled, stainless steel metal part 3 is fixedly attached to the sole 2. The synthetic resin sole 2 projects beyond the edges of the metal part 3 so as to join the upper portion of the shoe with the edges being dimensioned substantially wider in a direction toward the heel (not shown) of the sport shoe.

The metal part 3 is provided with two separate, dimensionally reinforced surface areas or sections 5, 6 in the toe and ball zones of the sport shoe. The surface areas or sections 5, 6 are reinforced by pressing or stamping. Both surface areas or sections 5, 6, separately or in combination, are provided with a plurality of embossed, smooth-surfaced, cone-like projections 7 and/or bevelled open projections or friction teeth 8 which are pressed through the metal part 3.

A smooth-surface bending zone 9 is arranged at the metal part 3 between the two surface sections 5, 6. The bending zone 9 is narrowed along two lateral edges so as to assure a desired flexibility of the sport shoe tread which is rigid in the area of the surface sections 5, 6. The narrowing of the bending zone 9 also provides for a maximum decrease in the overall weight of the shoe, as well as a good connection to the projecting synthetic resin sole 2.

A thin wire grid 10 is spot-welded on an inner surface of the metal part 3 for fixedly joining the metal part 3 to the synthetic resin sole 2. The wire grid 10 is embedded in the injection-molded or cast synthetic resin sole 2, with the resin also filling in the cone-like projections 7 and open projections 8.

The anchoring of the metal part 3 can also be supported by the projections 8 which are pressed through the metal part 3.

Even without employing a wire grid 10, the metal part 3 may be anchored to the synthetic resin sole 2 by placing uniformly distributed perforations 4 in the smooth-surfaced edge pieces and in the bending zones 9, optionally supported by the open projections, through which the material of the synthetic resin sole 2 extends to the tread surface.

While I have shown and described only one embodiment in accordance with the present invention, it is understood that the same is not limited thereto, but is susceptible of numerous changes and modifications as known to those skilled in the art, and I therefor do not wish to be restricted to the details shown and described herein, but intend to cover all such changes and modifications as are encompassed by the scope of the appended claims.

I claim:

1. A tread for a sport shoe which includes a synthetic resin sole having integrally molded projections extending out from a tread surface, characterized in that the tread includes a one-piece, thin-walled metal part, the thin-walled metal part includes at least two separate, dimensionally reinforced surface sections which bear integrally formed projections, means are provided for fixing an inner surface of the metal part to the synthetic resin sole, said fixing means includes a thin wire grid embedded in the synthetic resin sole, the thin wire grid being welded to the inner surface of the metal part, and in that the integrally molded projections of the sole fill the projections of the metal part.

2. A tread according to claim 1, characterized in that the reinforced surface sections are embossed with a plurality of at least one of smooth-surfaced projections pressed into the metal part or bevelled projections pressed through the metal part.

3. A tread according to one of claims 1 or 2, characterized in that the dimensionally reinforced surface sections are disposed in a toe and a ball area of the tread surface, the surface sections are surrounded by flat edge areas and are separated from each other by a flat bending zone, and in that the flat bending zone is formed by a narrowing of the metal part.

4. A tread according to claim 1, characterized in that the synthetic resin sole extends beyond a peripheral edge of the metal part.

5. A tread according to one of claims 1, 2, or 4, characterized in that the fixing means further includes a plurality of uniformly distributed perforations anchoring the metal part to the synthetic resin sole.

* * * * *